United States Patent [19]

Melter et al.

[11] 4,378,543

[45] Mar. 29, 1983

[54] LATCH RELAY WITH MANUAL RESET AND TEST

[75] Inventors: Craig H. Melter, West Baraboo; Donald R. Ritzenthaler, Reedsburg, both of Wis.

[73] Assignee: Gulf & Western Manufacturing Company, Southfield, Mich.

[21] Appl. No.: 322,535

[22] Filed: Nov. 18, 1981

[51] Int. Cl.[3] ..... H01H 45/02; H01H 9/20

[52] U.S. Cl. ..... 335/186; 335/166; 335/167

[58] Field of Search ..... 335/186, 164, 165, 166, 335/170, 167

[56] References Cited

U.S. PATENT DOCUMENTS

| | | | |
|---|---|---|---|
| 2,712,578 | 7/1955 | Theriault | 335/165 |
| 3,614,684 | 10/1971 | Egler | 335/166 |
| 3,842,375 | 10/1974 | Collette | 335/164 |
| 4,097,832 | 6/1978 | Ritzenthaler et al. | 335/166 |
| 4,220,937 | 9/1980 | Ritzenthaler | 335/186 |

*Primary Examiner*—Harold Broome

*Attorney, Agent, or Firm*—Body, Vickers & Daniels

[57] ABSTRACT

An improved spring biased reciprocable latch-reset member is provided for a relay of the type including an armature mounted on a support block for pivotal movement about an axis, a coil for displacing the armature from a first position to a second position when the coil is energized, a spring biasing the armature from the second position to the first position when the coil is de-energized, and an electrical contact controlled by the position of the armature. The latch-reset member is operable in response to displacement of the armature to the second position by energization of the coil to hold the armature in the second position, and is displaceable thereafter to release the armature for movement back to the first position by the armature biasing spring. The improvement in the latch-reset member provides for a component displaceable therewith to engage and displace the armature from the first to the second position thereof independent of energization of the coil, thus to provide for testing a circuit with which the relay is associated.

19 Claims, 7 Drawing Figures

LATCH RELAY WITH MANUAL RESET AND TEST

BACKGROUND OF THE INVENTION

The present invention relates to the art of electromechanical relays and, more particularly, to an improvement in an electromechanical latch relay having a manual reset mechanism.

The invention finds particular utility in connection with a double throw relay and accordingly will be described in detail with respect thereto. At the same time, however, the invention is adapted to be used in other electromechanical reset relays of the type which are latched in response to energization of the relay coil and manually unlatched or returned to a reset position.

Electromechanical relays have been provided heretofore with mechanisms for latching the relay closed when energized and requiring manual release of the latch to reset the relay. Such relays are widely used in a variety of electrical systems wherein it is desired, for example, to open a circuit to electrical equipment to render the latter inoperative in response to a fault and to require manual reclosing of the circuit following correction of the fault. A variety of relays of the foregoing type and for the foregoing purposes have been provided heretofore, such as those shown in prior U.S. Pat. Nos. 3,614,684 to Agler and 4,097,832 to Ritzenthaler et al, which two patents are incorporated by reference herein for background information. In these two patents there is disclosed a reciprocable latch-reset member which is spring biased in response to energization of the relay coil and displacement of the relay armature thereby to latch the armature in the displaced position independent of coil energization. When the coil is de-energized, displacement of the latch-reset member in the direction against the spring bias releases the relay armature for displacement back to the initial or reset position thereof.

Such a relay can be used, for example, in an electrical circuit for controlling electrical equipment such as a motor so as to open the circuit thereto in response to a fault. In this respect, the latter circuit is normally closed to energize the motor, and the relay coil is energized in response to the occurrence of a fault to open the circuit to the motor and, in a double throw relay, to close a normally open auxiliary circuit such as an alarm circuit to provide a visual or audible signal indicative of the fault condition. The alarm circuit is often remotely located with respect to the electrical equipment whereby, if the alarm circuit is defective or if the relay is defective with respect to closing the alarm circuit, a fault can go undetected for a considerable period of time. While the circuit to the electrical equipment may be opened in response to the fault, early detection and correction of the fault condition may be critical to prevent damage to the electrical equipment or other equipment with which it is associated. Furthermore, while a visual or audible alarm circuit has been referred to as being closed in conjunction with the opening of a circuit to electrical equipment, it will be appreciated that an auxiliary function circuit could be closed in response to a fault or other relay control signal, whereby a defect in the auxiliary circuit, or the relay contacts closing the same, would result in the auxiliary function not being achieved.

Accordingly, it becomes desirable to provide the relay with a testing mode, independent of actuation thereof by energization of the relay coil, to enable testing the operability of the relay in connection with the alarm, auxiliary function, or other circuit closed thereby in response to opening the normally closed main circuit. The two aforementioned United States patents do not provide a testing mode for the relays shown therein, and the only known arrangement heretofore provided in conjunction with such relay structures requires the use of a plunger member separate from the latch-reset member for displacing the relay armature toward the coil independent of coil energization. The latter arrangement, in addition to requiring at least one additional component part and a support structure therefor in the relay assembly, results in displacement of the latch-reset member into the latching position relative to the relay armature. Therefore, the latch-reset member must be manually displaced to achieve return of the armature to the reset position following a test function. Such resetting is often overlooked, whereby time is lost in having to return to the location of the relay to reset the same before the main circuit can function. This disadvantage is in addition to such relays being expensive to manufacture and requiring two manual operations to be performed to achieve a test.

BRIEF DESCRIPTION OF THE INVENTION

The foregoing and other disadvantages of prior latch relays are overcome by the present invention which provides for the latch-reset member to have a test position relative to a relay armature and in which the armature is displaced toward the relay coil independent of energization thereof, whereby the latch, reset and test functions are achieved through the use of a common component part of the relay assembly. More particularly, the latch-reset member is reciprocable relative to the armature between latching and reset positions and is biased in the direction from the reset toward the latching position. When the armature is in a first position, the latch-reset member is biased against the armature. When the coil is energized, the armature is displaced to a second position thereof and the latch-reset member is biased into the latching position to hold the armature in the second position independent of coil energization. When the latch-reset member is then displaced against the spring bias toward the reset position, the armature is released for return to the first position by the armature biasing spring to reset the relay, after which release of the latch-reset member returns the latter into engagement with the armature. In accordance with the present invention, the latch-reset member is adapted to be displaced in the direction of reciprocation from the reset position to a test position and, during such displacement, a portion of the latch-reset member engages and displaces the armature from the first position to the second position thereof independent of coil energization. In the embodiment disclosed, the contact controlled by the armature is adapted to close an alarm or auxiliary function circuit when the armature is in the second position thereof, whereby it will be appreciated that displacement of the latch-reset member to the test position enables testing the alarm or auxiliary function circuit independent of closing thereof by the relay coil in response to a fault.

Preferably, the latch-reset member includes a body portion supported for reciprocation transverse to the pivot axis of the armature and provided with integral abutment and camming components longitudinally spaced apart thereon. The abutment component provides a shoulder and a latching surface operable, respectively, to hold the latch-reset member in the reset position and to releasably hold the armature in the second position thereof following energization of the relay coil. The cam component is spaced from the abutment component and is positioned on the body portion so as to engage the armature when the body portion is displaced from the reset position and in the direction of reset. During such movement, the cam component engages and displaces the armature from the first position to the second position thereof, and such displacement is accompanied by a corresponding displacement of the abutment component in the reset direction. Return movement of the body portion results in disengagement of the cam component with the armature and return thereof to the second position by the armature spring, and then re-engagement of the shoulder of the abutment component with the armature. Thus, testing is achieved independent of coil energization and latching engagement of the latching member with the relay armature.

It is accordingly an outstanding object of the present invention to provide an improved manually releaseable latch relay having a latch-reset member operable to provide a test mode for a circuit controlled by the relay and independent of energization of the relay coil.

Another object is the provision of a manually releaseable latch relay having a test mode for a circuit controlled thereby and which is of simplier construction and operation and is more economical to produce than existing relays providing a test function.

A further object is the provision of a manually releaseable latch relay of the foregoing character having a single reciprocably displaceable latch-reset member operable to achieve latching and reset functions with respect to a relay armature and to displace the armature to a circuit testing position independent of energization of the relay coil.

Yet a further object is the provision of a manually releaseable latch relay of the foregoing character in which a one piece latch-reset member includes an abutment component for achieving latching and reset functions with respect to the relay armature and a cam component spaced from the abutment component and operable to engage and displace the armature to achieve a testing function with respect to a circuit controlled by the relay.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
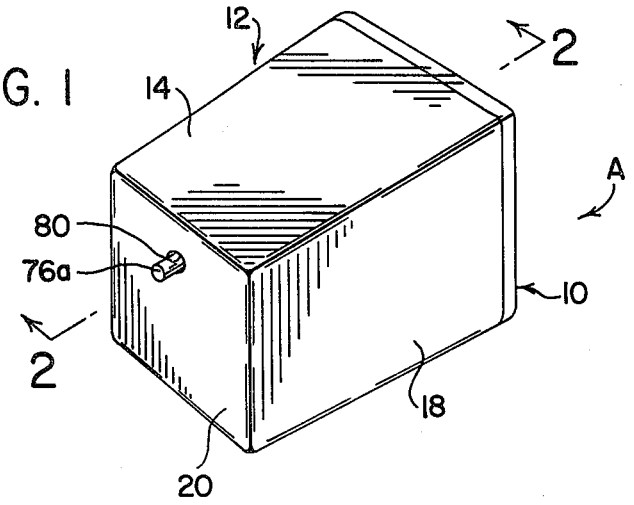
FIG. 1 is a perspective view of a relay in accordance with the present invention.

With reference now to the drawings wherein the showings are for the purpose of illustrating a preferred embodiment of the invention only and not for the purpose of limiting the invention, FIGS. 1–5 show a latch relay A having a terminal block 10 for supporting a plurality of terminals in accordance with standard relay construction. An appropriate plastic cover 12 is suitably attached to terminal block 10 and, in the orientation illustrated, includes upper and lower walls 14 and 16, respectively, spaced apart side walls 18 and an end wall 20 spaced from terminal block 10. A generally L-shaped bracket 22 has a lower leg 24 suitably attached to a bracket support member **10*a* which is integral with terminal block 10, and an inner leg 26 extending upwardly from leg 24 and having an upper end 28 providing a fulcrum for the relay armature assembly to be described later. Bracket 22 is adapted to support component parts of the relay as set forth hereinafter and further includes a support plate 30 attached to leg 26 by means of a strut 32 and engaging between cover walls 14, 16 and 18 to support and stabilize the bracket assembly and relay parts within cover 12. The bracket assembly, in being fixedly secured to terminal block 10, enables the cover 12** to be slipped over the bracket and the relay parts supported thereby and to be suitably secured to the terminal block to provide a unitary structure.

The relay includes an armature assembly 34 comprising an armature plate 36 formed from a high permeable material, such as soft magnetic iron. Armature plate 36 has one end 38 pivotally interengaged with fulcrum end 28 of bracket leg 26 in accordance with standard relay design. A tension spring 40 has one end attached to end 38 of the armature plate and the other to a tab 42 on bracket leg 26 to provide an armature biasing spring which, in the orientation shown in FIGS. 2–4, biases armature assembly 34 in a counterclockwise direction about fulcrum end 28. Armature assembly 34 further includes a plate 44 of electrically insulating material which is suitably secured to armature plate 36 for displacement therewith. Insulator plate 44 extends beyond end 46 of armature plate 36 and terminates in a generally straight end face 48. Armature assembly 34 further includes a contact holder suitably secured to insulator plate 44 and including a base portion 50 and upwardly extending leg 52 for the purpose set forth hereinafter. The contact holder supports a contact blade 54 for displacement with armature plate 36, and contact blade 54 carries contact elements 56 and 58 on the outer end thereof. Contacts 56 and 58 are connected by blade 54 to a common lead 60 which in turn is connected to a corresponding terminal blade on terminal block 10. Further, contacts 56 and 58 are disposed between spaced apart contacts 62 and 64 on the inner ends of corresponding terminal blades and are cooperable with contacts 62 and 64 as set forth hereinafter.

Figure 2:
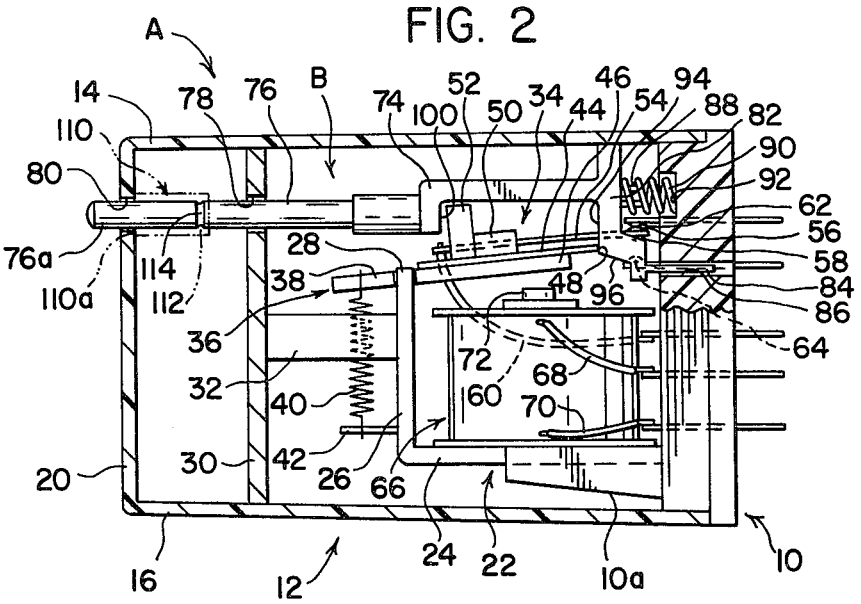
FIG. 2 is a sectional elevation view of the relay taken along line 2—2 in FIG. 1 and showing the latch-reset member in the reset position thereof.
Figure 3:
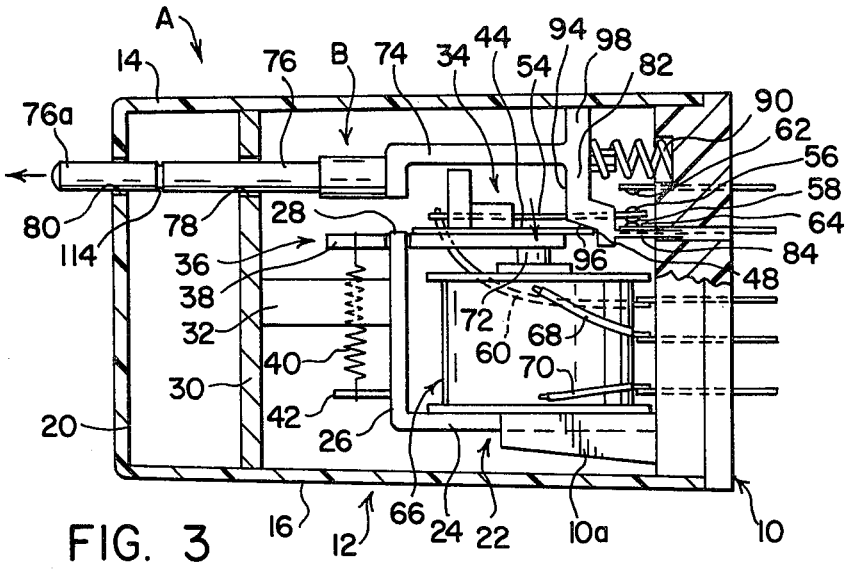
FIG. 3 is a sectional elevation view similar to FIG. 2 and showing the latch-reset member in the latched position thereof.

A relay coil 66 is suitably secured to leg 24 of bracket 22 and includes electrical leads 68 and 70 and an upwardly facing generally cylindrical pole piece 72. Leads 68 and 70 are connected to corresponding terminal blades supported on terminal block 10 and, as is well known, energization of coil 66 by passing current through leads 68 and 70 results in displacement of armature assembly 34 clockwise about fulcrum end 28 from the first position thereof shown in FIG. 2 to the second position shown in FIG. 3. Contacts 62 and 64 are supported on terminal block 10 for co-action with contacts 56 and 58, respectively, in accordance with the pivotal disposition of armature assembly 34. More particularly in this respect, when armature assembly 34 is in the first position as shown in FIG. 2 contacts 56 and 62 are closed and contacts 58 and 64 are open. When coil 66 is energized, armature assembly 34 is displaced from the first position to the second position shown in FIG. 3 in which contacts 58 and 64 are closed and contacts 56 and 62 are open. In the absence of armature assembly 34 being latched in the second position as described hereinafter, spring 40 is operable upon de-energization of coil 66 to displace the armature assembly from the second position back to the first position.

Figure 6:
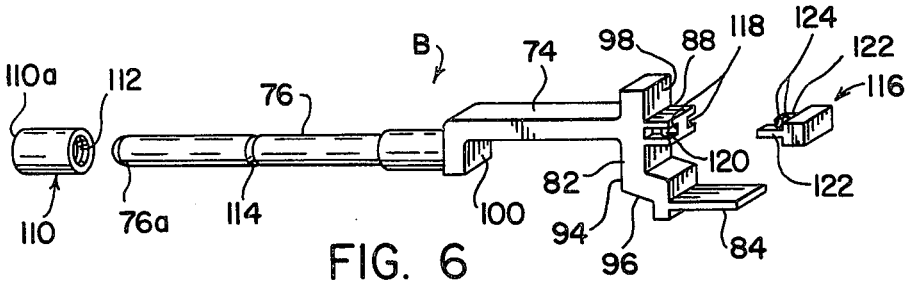
FIG. 6 is an enlarged perspective view of the latch-reset member.

As seen in FIGS. 2–5 and shown in detail in FIG. 6, a latch member B, preferably of one-piece molded plastic construction, is supported between wall 20 of cover 12 and terminal block 10 for reciprocation transverse to the armature axis defined by fulcrum end 28 of bracket leg 26. Latch-reset member B includes a longitudinally extending body portion 74 having a generally cylindrical pin portion 76 at one end thereof. Pin portion 76 is slidably received in openings 78 and 80 in plate 30 and cover wall 20, respectively, and has an outer end 76*a* by which the pin portion and thus body portion 74 is manually displaceable for the purpose set forth hereinafter. The opposite end of body portion 74 is provided with a depending abutment component 82 having a generally flat forwardly extending guide tongue 84 on the lower end thereof received in a recess 86 provided therefor in terminal block 10. The latter end of body portion 74 is also provided with a forwardly extending stud 88, and a compression spring 90 is interposed between abutment component 82 and terminal block 10 and has one end surrounding stud 88 and the other disposed in a spring recess 92 in the terminal block. Abutment component 82 provides a downwardly extending generally flat shoulder 94 facing the armature assembly, and an inclined latch surface 96 is provided at the lower edge of shoulder 94 which tapers away from the shoulder toward terminal block 10 and cover wall 16. Preferably, body portion 74 of latch-reset member B includes an upwardly extending protuberance 98 generally overlying abutment component 82 for the purpose set forth hereinafter. From the foregoing description, it will be appreciated that latch-reset member B is supported at its opposite ends for reciprocation relative to armature assembly 34 and transverse to the armature axis, that the latch-reset member is adapted to be displaced from left to right in FIGS. 2 and 3 by pushing end 76*a* in the latter direction, and that such displacement of the latch-reset member is against the bias of spring 90 which is thus operable to displace the latch-reset member from right to left upon release of end 76*a*.

With regard to the operation of the relay and latch-reset member B as thus far described, shoulder 94 of abutment component 82 is adapted to abut against end 48 of insulator plate 44 of the armature assembly when the latter is in the first position thereof shown in FIG. 2. In this disposition of the component parts, latch-reset member B is in the reset position and shoulder 94 is biased against end 48 by spring 90. When coil 66 is energized to displace armature assembly 34 to the second position thereof shown in FIG. 3, edge 48 is displaced from shoulder 94 whereby latch-reset member B is released for displacement from right to left by spring 90 to the position shown in FIG. 3 which is the latching position of the of the latch-reset member. In the latter position, latch surface 96 of abutment component 82 engages the upper edge of end 48 of insulator plate 44 to hold the armature assembly in the second position. In the latching position of the latch-reset member, protuberance 98 engages against the inner surface of cover wall 14 and thus cooperates with latch surface 96 to impose a wedging action on the armature assembly. Further, such engagement between protuberance 98 and wall 14 avoids the application of strain which would otherwise be imposed on guide tongue 84 as a result of the upward bias of the armature assembly against latch-reset member B by armature spring 40 when coil 66 is de-energized. Latch-reset member B will remain in the latching position following de-energization of relay coil 66 and, when it is desired to reset the relay, end 76*a* of the latch-reset member is displaced from left to right in FIG. 3 a distance sufficient for shoulder 94 to move to the right beyond end 48 of insulator plate 44, whereupon armature spring 40 displaces the armature assembly back to the first position shown in FIG. 2. Release of end 76*a* of the latch-reset member then results in shoulder 94 being displaced back into abutting engagement with end 48 by spring 90.

Figure 4:
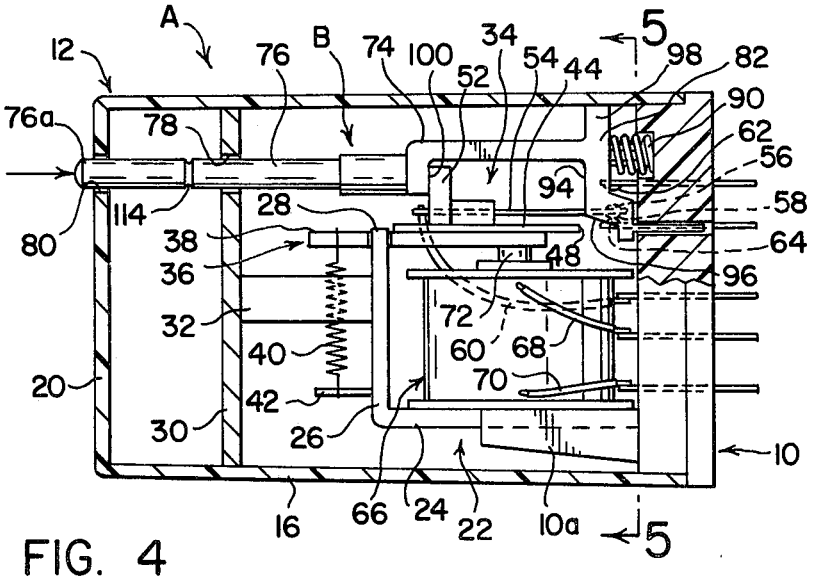
FIG. 4 is a sectional elevation view similar to FIG. 2 and showing the latch-reset member in the test position thereof.
Figure 5:
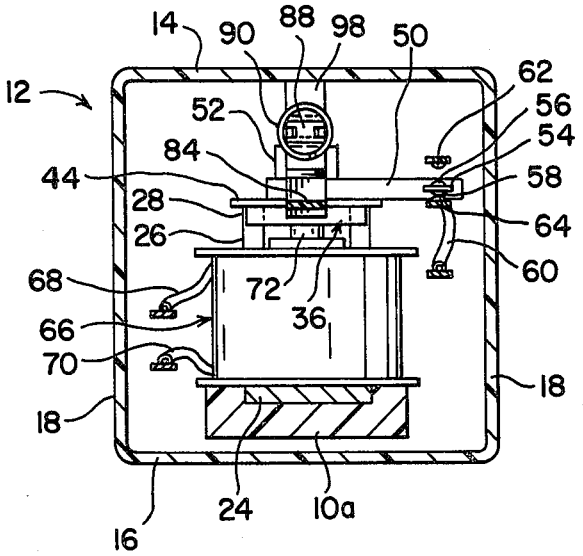
FIG. 5 is a sectional elevation view of the relay taken along line 5—5 in FIG. 4.

In accordance with the present invention, latch-reset member B is displaceable to a test position in which it is operable to displace armature assembly 34 to the second position thereof independent of energization of coil 66 to provide for testing a circuit which, in the disclosed embodiment, would be closed by engagement of contacts 58 and 64 of the relay. In the preferred embodiment, as best seen in FIG. 4 of the drawing, the test position for latch-reset member B is to the right of the reset position shown in FIG. 2, and displacement of the latch-reset member into the test position is achieved by pushing end 76*a* to the right from the reset position. In the embodiment shown, displacement of armature assembly 34 from the first to the second position thereof during movement of the latch-reset member to the test position is achieved by means of a depending cam face 100 provided on body portion 74 and spaced from shoulder 94 of abutment component 82 in the direction toward outer end 76*a* of the latch-reset member. Cam face 100 is slightly spaced to the left of leg 52 of the contact support on the armature assembly when latch-reset member B is in the reset position thereof, as will be seen from FIG. 2, and as will be appreciated from FIG. 4, displacement of latch-reset member B from the reset position to the test position causes cam face 100 to engage leg 52 and thus pivot armature assembly 34 to the second position thereof. Such displacement of the latch-reset member to the test position is against the bias of spring 90 whereby, upon release of end 76*a*, spring 90 is operable to return the latch-reset member to the reset position in which shoulder 94 abuts against end 48 of insulator plate 44. Further in this respect, it will be appreciated that the spacing between cam face 100 and leg 52 of the contact support provides for shoulder 94 of abutment component 82 to move to the right and out of engagement with end 48 before cam face 100 engages leg 52 during movement of the latch-reset member to the test position. Likewise, during return movement of the latch-reset member from the test position toward the reset position, armature assembly 34 is returned by armature spring 40 to the first position thereof before shoulder 94 reaches the reset position to abut against end 48. Thus, testing is achieved independent of energization of the relay coil and independent of latching engagement of the armature assembly in its second position.

Figure 7:
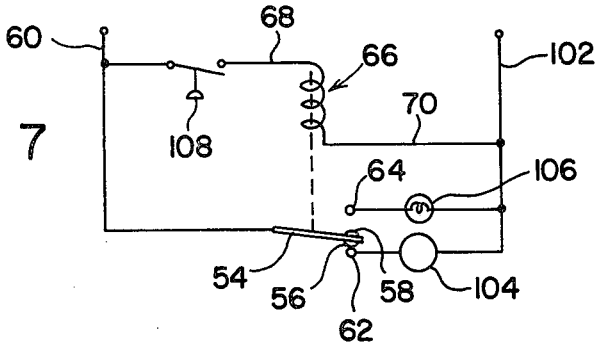
FIG. 7 is a schematic wiring diagram illustrating a use of the relay of the present invention.

As an illustrative example of the use of the relay assembly described hereinabove, reference may be had to the electrical control system schematically illustrated in FIG. 7 of the drawing. In this system, the electrical control voltage is applied between line 60, which is common to contacts 56 and 58 through contact blade 54, and a line 102 which is common to contacts 62 and 64. The system is adapted to control a pump motor 104 which has its leads connected between line 102 and relay contact 62, and the system includes an alarm device such as a light 106 having its leads connected between line 102 and relay contact 64. Relay 66 has its leads 68 and 70 connected across lines 60 and 102 in series with a fault responsive device, such as pressure responsive switch 108 which would monitor pressure in the fluid system supplied by the pump driven by motor 104. Switch 108 is normally open, whereby relay coil 66 is deenergized and the armature assembly is in the first position thereof illustrated in FIG. 2 in which contacts 56 and 62 are closed as shown in FIG. 7 to connect pump motor 104 across lines 60 and 102. Switch 108 is adapted to close in response to an undesirable pressure in the fluid system and, upon closing, connects relay coil 66 across lines 60 and 102. Accordingly, the armature assembly is displaced from the first position to the second position shown in FIG. 3 in which contacts 58 and 64 are closed and contacts 56 and 62 are open. It will be appreciated from FIG. 7 and the foregoing description that such displacement of the armature assembly opens the circuit to pump motor 104 and connects alarm light 106 across lines 60 and 102, thus to indicate a fault condition, and that the armature assembly is latched in the second position. Therefore, clearing of the fault and resetting of the relay is required in order to reconnect pump motor 104 across lines 60 and 102. Upon clearing of the fault and obtaining an acceptable pressure in the fluid system, pressure responsive switch 108 opens to de-energize relay coil 66, thus enabling the relay to be reset by displacement of the latch-reset member to the reset position. Such displacement of the latch-reset member releases the armature assembly for return to the first position thereof under the bias of the armature spring, whereby contacts 56 and 62 close to re-energize the pump motor.

In the event that relay coil 66 is energized in the foregoing manner to open the circuit to pump motor 104 and there is a defect in the alarm circuit resulting, for example, from faulty engagement between contacts 58 and 64 or a defective alarm bulb, the fault can go undetected and thus endanger component parts in the fluid system and/or equipment operated or controlled thereby. The occurrence of such a problem is advantageously minimized in accordance with the present invention by enabling momentary closure of contacts 58 and 64 in the alarm circuit independent of energization of the relay coil to test operability of the alarm circuit. In this connection, it will be appreciated from the foregoing description of the latch-reset member that displacement thereof to the test position displaces the armature assembly against the bias of the armature spring to bring contacts 58 and 64 into engagement so as to connect alarm bulb 106 across lines 60 and 102. Such a test continues only so long as the operator maintains the latch-reset member in the test position and, upon the operator's release of end 76*a* of the latch-reset member, the latter is spring biased back to the reset position and the armature assembly is returned by the armature spring to the first position to connect pump motor 104 across lines 60 and 102.

The preferred latch-reset member structure illustrated in FIG. 6 advantageously enables modifying the relay assembly to selectively lock out either the latching function or the reset function. In this respect, a spacer sleeve 110 having a suitable internal detent 112 can be introduced onto pin portion 76 for detent 112 to engage in a groove 114 provided in pin portion 76. When so engaged, outer end 110*a* of sleeve 110 abuts against the inner side of end wall 20 of housing 12 when the latch-reset member is in the reset position, as shown by broken lines in FIG. 2. Therefore, upon energization of relay coil 66 and displacement of the armature assembly to the position shown in FIG. 3, sleeve 110 prevents displacement of latch-reset member B to the latching position, thus providing for the relay to have only testing and reset functions. Alternatively, if desired, a spacer component 116 can be releaseably interengaged with stud 88 on abutment component 82 for displacement therewith. For this purpose stud 88 is provided with opposed slots 118 having detents 120 therein, and spacer 116 is provided with legs 112 received in slots 118 and having recesses 124 interengaging with detents 120. Spacer component 116 would be of a length providing for engagement therewith with terminal block 10 before cam face 100 engages leg 52 of the contact holder on armature assembly 34 in response to displacement of latch-reset member B toward the right from the reset position shown in FIG. 2. Thus, spacer 116 would provide for the relay to have only latching and reset functions.

While considerable emphasis has been placed herein on the structures of the component parts of the relay illustrated in the drawings, it will be appreciated that many changes can be made therein without departing from the principles of the present invention. With regard in particular to the latch-reset member, it is only necessary in accordance with the present invention that the latter be of a common structure with respect to achieving the latching, reset and test functions, and achieving the latter function independent of energization of the relay coil and latching engagement of the armature assembly in the second position. More particularly in this respect, it is only important that the component or components of the latch-reset member for achieving the latching, reset and testing functions be displaceable together as a unit. Manual displacement to achieve the reset and testing functions can be achieved in any desired manner. In this respect, for example, while it is preferred to provide the latch-reset member with an integral push rod extending outwardly of the relay cover to support the body portion and to facilitate manual displacement, it will be appreciated that the body portion could otherwise be supported for reciprocation and that the push rod could be separate from the body portion and suitably supported to engage and displace the latter. Alternatively, the body portion could be provided with an operating stem extending upwardly or laterally outwardly therefrom through an elongate slot in the top or a side wall of the cover to facilitate manual displacement. Furthermore, it will be appreciated that the latch-reset member and armature assembly can be provided with interengageable camming arrangements other than that illustrated herein to facilitate displacement of the armature assembly to its second position upon displacement of the latch-reset member to the test position. It is to be distinctly understood, therefore, that the foregoing descriptive matter is to be interpreted merely as illustrative of the present invention and not as a limitation.

Having thus described the invention, it is claimed:

1. In a manual reset relay of the type having armature means pivotal about an armature axis between first and second positions, first biasing means for biasing said armature means toward said first position, coil means for displacing said armature means from said first position to said second position when said coil means is energized, reciprocable support means having reset and latching positions relative to said armature means, said support means carrying latch means for displacement therewith between said reset and latching positions, second biasing means responsive to displacement of said armature means to said second position by said coil means to displace said support means from said reset to said latching position for said latch means to releaseably hold said armature means in said second position, means to manually displace said support means from said latching position toward said reset position to release said armature means for displacement to said first position by said first spring means, the improvement comprising: said reciprocable support means being displaceable to a testing position and including means displaceable therewith to said testing position to engage and displace said armature means from said first to said second position independent of energization of said coil means.

2. A relay according to claim 1, wherein said support means is reciprocable transverse to said armature axis.

3. A relay according to claim 1, wherein said reciprocable support means includes a body portion having opposite ends in the direction of reciprocation, and said means displaceable with said support means to said testing position includes cam means on said body portion spaced from said latch means in said direction of reciprocation.

4. A relay according to claim 3, wherein one of said ends of said body portion is a forward end with respect to the direction between said latching and reset positions, and said cam means is between said latch means and the other of said opposite ends.

5. A relay according to claim 4, wherein said means to manually displace said support means includes said other of said opposite ends of said body portion.

6. A relay according to claim 3, wherein said latch means and said cam means are integral with said body portion.

7. A relay according to claim 6, wherein said direction of reciprocation is transverse to said armature axis.

8. A relay according to claim 7, wherein one of said ends of said body portion is a forward end with respect to the direction between said latching and reset positions, and said cam means is between said latch means and the other of said opposite ends.

9. A relay according to claim 8, wherein said means to manually displace said support means includes said other of said opposite ends of said body portion.

10. A relay according to claim 1, wherein said armature means has opposite ends, one of said ends of said armature means being closer to said armature axis than the other, said support means being reciprocable transverse to said armature axis, and said means displaceable with said support means to said testing position engages said armature means in the direction from said one end thereof toward the other.

11. A relay according to claim 10, wherein said means displaceable with said support means to said testing position engages said armature means between said opposite ends thereof.

12. A relay according to claim 11, wherein said means displaceable with said support means to said testing position includes cam means.

13. A relay according to claim 12, wherein said reciprocable support means includes a shoulder abutting against said other of said ends of said armature means when said support means is in said reset position, said cam means being spaced from said shoulder toward said one of said opposite ends of said armature means, and said cam means being spaced from said armature means when said support means is in said reset position.

14. A relay according to claim 13, wherein said support means includes a reciprocable support member having an abutment component thereon providing said shoulder and said latch means, said second biasing means being spring means biasing said support member in the direction from said other toward said one end of said armature means.

15. A relay according to claim 14, wherein said means to manually displace said support means is integral with said support member.

16. A relay according to claim 15, wherein said abutment component and said cam means are integral with said support member.

17. A relay according to claim 13, and means to selectively prevent displacement of said support means from said reset toward one of said latching and said testing positions.

18. A relay according to claim 17, wherein said support means includes a reciprocable support member and said means to manually displace said support means includes pin means extending in the direction of reciprocation from said support member, said relay including housing wall means transverse to said pin means, and said means to selectively prevent displacement of said support means including sleeve means removably mountable on said pin means to engage said wall means to prevent displacement of said support means from said reset position to said latching position.

19. A relay according to claim 17, wherein said support means includes a reciprocable support member having an end, said relay including housing wall means spaced from said end of said support member, said second biasing means being between said end of said support member and said housing wall means and biasing said support member away from said wall means, and said means to selectively prevent displacement of said support means including spacer means removably mounted on said end of said support member to engage said wall means to prevent displacement of said support means from said reset to said testing position.

* * * * *